United States Patent [19]

Burmester

[11] Patent Number: 4,785,694

[45] Date of Patent: Nov. 22, 1988

[54] SPRING CLIP EXTRACTOR

[75] Inventor: Kenneth M. Burmester, Oshkosh, Nebr.

[73] Assignee: Platte River Welding-Tool Division, Oshkosh, Nebr.

[21] Appl. No.: 852,701

[22] Filed: Apr. 16, 1986

[51] Int. Cl.[4] ..... B25B 27/00

[52] U.S. Cl. ..... 81/485; 81/486; 81/426; 29/235

[58] Field of Search ..... 81/3.7, 3.55, 9.3, 3.56, 81/485, 355, 486, 488, 418, 424.5, 426; 29/215, 216, 220, 225, 278, 283.5, 235; 254/10.5; 269/157; 294/11, 34, 103.1

[56] References Cited

U.S. PATENT DOCUMENTS

| | | | |
|---|---|---|---|
| 1,886,732 | 11/1932 | Poland | 81/426 X |
| 2,700,910 | 2/1955 | Van Niel | 81/426 X |
| 2,915,927 | 12/1959 | DeGenova | 29/235 |
| 3,091,840 | 6/1963 | Anderson | 29/225 |
| 3,342,090 | 9/1967 | Martin | 81/426 X |
| 3,822,468 | 7/1974 | Mueller | 81/3.56 X |
| 3,918,757 | 11/1975 | Huber | 294/103.1 X |

*Primary Examiner*—Debra Meislin

*Attorney, Agent, or Firm*—Fleit, Jacobson, Cohn & Price

[57] ABSTRACT

An elongated extraction tool body slidably mounts a laterally extending abutment element closely spaced from a laterally extending jaw fixed to one end of the body. The abutment element is displaced from a limit position against a spring bias, by a thumb contact member, to a reaction establishing position enabling the jaw to exert a deforming force.

4 Claims, 1 Drawing Sheet

SPRING CLIP EXTRACTOR

BACKGROUND OF THE INVENTION

Field of the Invention

This invention relates to a tool for extracting parts from a relatively inaccessible installation.

Various special tools have been designed for extracting parts of an assembly from locations at which it is difficult to remove such parts with ordinary tools such as screw drivers, wrenches and pliers. Such specialized tools have elongated bodies to facilitate insertion into restricted spaces and force transmitting jaws or tool ends for engagement of the part to be extracted. Specialized tools are however not available and/or have not been regarded as effective for extraction of certain parts that must be deformed within restricted spaces of an inaccessible installation, such as the spring clips holding the links of a conveyor chain assembled.

It is therefore an important object of the present invention to provide a specialized tool for extraction of parts by deformation thereof within a restricted space of an inaccessible installation, avoiding disassembly of the installation as heretofore deemed necessary for exposure of such parts.

A more particular object of the invention is to provide an extraction tool for removal of spring retainer clips from links of a conveyor chain.

SUMMARY OF THE INVENTION

In accordance with the present invention, the elongated body of an extraction tool has a deforming jaw fixed to one end thereof for engagement with the prong of a spring retainer clip installed between spaced pins interconnecting a link of a conveyor chain with adjacent chain links. The jaw projects laterally in one direction from the elongated body in parallel spaced relation to an abutment element engageable with the side edge of the link to establish a reaction point toward which the jaw may exert a prong displacing force. The abutment element is displaceable relative to the jaw from a limit position against a spring bias by means of a plunger slidably mounted in the tool body. Spaced collars are fixed to the tool body to respectively limit such displacement of the abutment element to its limit position closely spaced from the jaw, and form a reaction surface for the biasing spring carried on a portion of the plunger projecting from the end of the tool body opposite the jaw. The plunger is displaced against the spring bias and then a deforming force is exerted by the jaw, in sequence, to deform the prong of the retainer clip engaged by the jaw. Toward that end, a hand finger gripping bar is fixed to the tool body intermediate its ends and a thumb contacting member is connected to the end of the plunger opposite the end from which the abutment element extends. The finger gripping bar and thumb contact member thus form a hand grasping assembly through which the reaction point is established and the jaw is displaced relative thereto to transmit a deforming force.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figures 1, 2, 3, 4, 5, 6, 7:
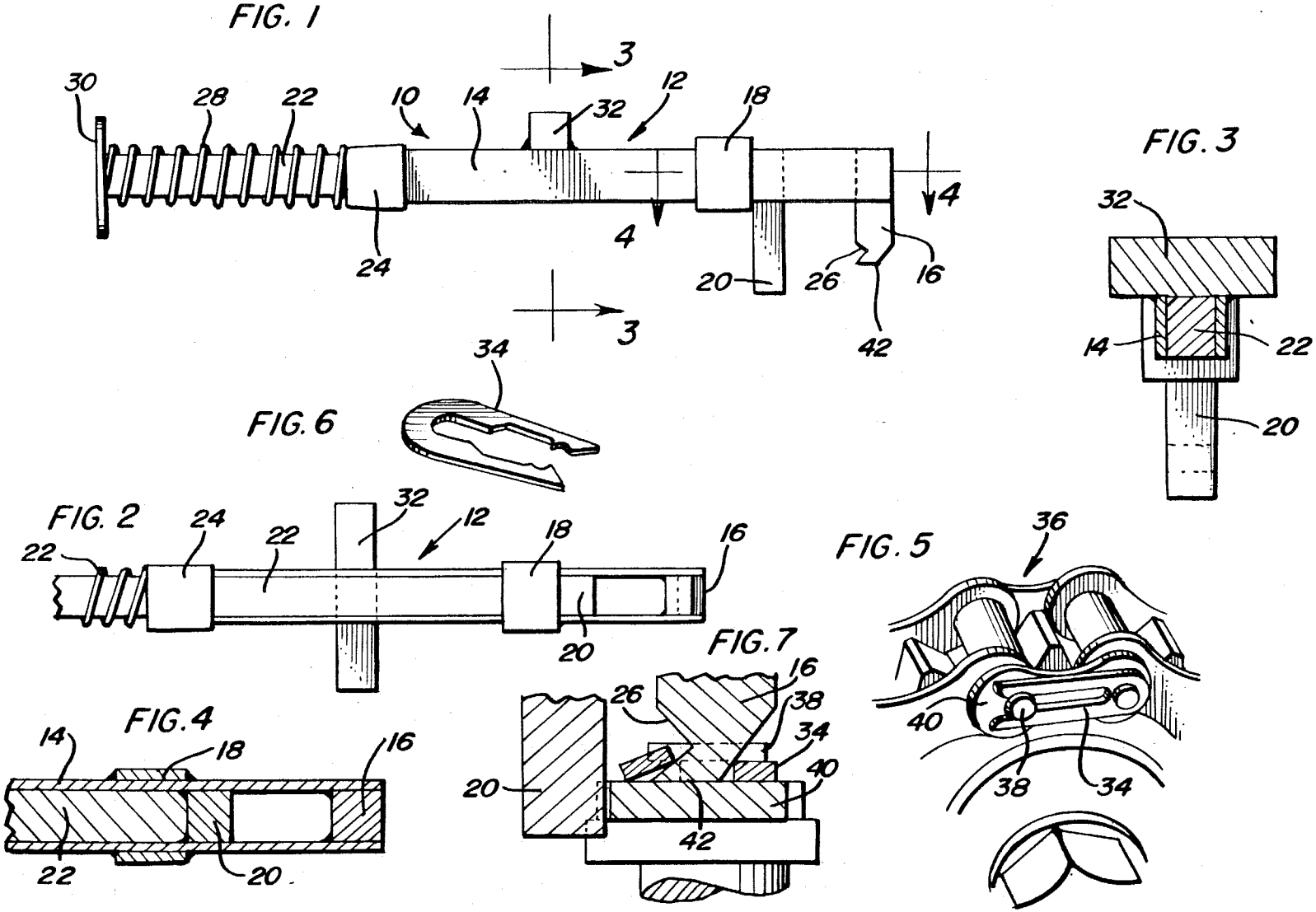
FIG. 1 is a side elevation view of an extraction tool constructed in accordance with one embodiment of the invention.
FIG. 2 is a partial bottom plan view of the tool shown in FIG. 1.
FIG. 3 is an enlarged transverse section view taken substantially through a plane indicated by section line 3—3 in FIG. 1.
FIG. 4 is an enlarged partial section view taken substantially through a plane indicated by section line 4—4 in FIG. 1.
FIG. 5 is a partial perspective view showing a conveyor chain installation of a retainer clip to be extracted by the extraction tool shown in FIGS. 1–4.
FIG. 6 is a perspective view of the disassembled retainer clip.
FIG. 7 is a partial side section view of the extraction tool in use with the retainer clip being extracted.

Referring now to the drawing in detail, FIG. 1 illustrates the entire extractor tool of the present invention, generally referred to by reference numeral 10. The tool consists of an elongated body generally denoted by reference numeral 12. The body 12 constitutes a lever element as will be explained hereinafter, and in the illustrated embodiment is formed by two parallel spaced bars 14 interconnected at one end by a laterally extending jaw 16 to which the bars are fixed, as by welding, as more clearly seen in FIG. 4. The bars 14 are also interconnected in spaced relation to each other by an external tubular collar 18 in longitudinally relation to the jaw 16. The collar 18 also functions to limit displacement of an abutment element 20 secured to one end of a plunger 22 from which the abutment element extends laterally. The plunger 22 projects from the end of the elongated body 12 opposite the jaw 16. A second tubular collar 24 is externally secured to the bars 14 of body 12, as by welding, at that end from which the plunger 22 projects. In the embodiment shown, the abutment element 18 and jaw 16 extend from the body 12 at right angles in parallel spaced relation to each other.

The jaw 16 is formed with a notch 26 on the side thereof confronting the abutment element 20. The abutment element being secured to one end of plunger 22 is slidably displaceable therewith relative to the body 12 and jaw 16. The plunger 22 as shown in FIGS. 2, 3 and 4 is in slide bearing contact with the body 12 between its bars 14. The abutment element 20 and plunger 22 slidably displaceable relative to body 12 in one direction from a limit position engaging the collar 18 as shown in FIGS. 1, 2 and 4.

The plunger 22 and abutment element 20 are biased to the limit position by a coil spring 28 carried on the portion of the plunger 22 projecting from the end of the body 12 to which the collar 24 is fixed. Opposite ends of spring 28 therefore react against the collar 24 and a thumb contacting member 30 fixed to the projecting end of the plunger. The member 30 forms part of a manipulative handle assembly for the tool with a finger gripping bar 32 fixed to the body 12 intermediate the collars 18 and 24. An axial force may be applied to the plunger 22 against the bias of spring 28 through the member 30 in order to displace the abutment element 20 to a reaction establishing position as shown in FIG. 7.

The finger gripping bar 32 projects laterally in opposite directions from body 12 on that side opposite the side from which the jaw 16 and abutment element 20 extend.

The tool 10 is grasped and held in one hand by placing two fingers over the gripping bar 32 on either side of the body 12 with member 30 engaging the base of the thumb. In this manner the abutment element 20 may be displaced by the thumb to the reaction establishing position and a deforming force is generated at the jaw 16 as will be explained hereinafter in detail.

FIG. 6 shows a typical spring clip 34 which is mounted in a typically inaccessible installation, such as a conveyor chain 36 as shown in FIG. 5. The spring clip 34 when installed as shown bridges and engages a pair of pins 38 projecting from the connecting link 40 of the conveyor chain. The tool 10 as hereinbefore described is designed to extract the spring clip 34 from the foregoing conveyor chain installation.

As shown in FIG. 7, the end 42 of the jaw 16 laterally spaced from one end of the tool body 12 is placed in sliding contact with the link 40 between the prongs of the clip 34 and between the pins 38. The abutment element 20 is then displaced to its reaction establishing position, as aforementioned, into engagement with the side edge of link 40 relatively close to the location at which the jaw 16 engages the prong of clip 34 in its notch 26. It will therefore be apparent that a continued axial displacing force manually applied after the abutment element 20 engages the edge of clip 34 causes axial displacement of jaw 16 relative to abutment element 20, as viewed in FIG. 7, to exert a prong deforming force on the clip 34 through jaw 16. The clip 34 may thereby be readily deformed and released from the pins 38 for removal with the jaw 16 from its conveyor chain installation.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. For use limited to removing a retainer from a surface of a part having an edge extending transversely from the surface, am extractor tool comprising an elongated body, a deforming jaw fixed to the body and projecting laterally therefrom, abutment means movably mounted on the body and projecting laterally therefrom beyond the jaw for establishing a reaction point on said edge in response to displacement relative to the jaw while in engagement with the retainer, handle means for exerting a displacing force on the abutment means causing said displacement thereof into engagement with the edge of the part establishing said reaction point thereon and spring biased displacing means connected to the handle means for continued transmission of the displacing force to the abutment means following said establishment of the reaction point causing displacement of the jaw relative to the abutment means along the surface of the part to deform the retainer while in engagement with the jaw.

2. The tool as defined in claim 1 wherein the handle means comprises a finger gripping bar fixed to the body and thumb contacting means connected to the spring biased displacing means for effecting said displacement of the abutment means into engagement with the part.

3. For use limited to removing a retainer from a surface of a part having an edge extending transversely from the surface, an extractor tool comprising an elongated body, a deforming jaw fixed to the body and projecting laterally therefrom, abutment means movably mounted on the body and projecting laterally therefrom beyond the jaw for establishing a reaction point on said edge in response to displacement relative to the jaw while in engagement with the retainer, a plunger connected to the abutment means and slidably mounted in the body, spring means mounted on the plunger for biasing the abutment means away from the jaw, means connected to the body for limiting displacement of the abutment means by the spring means, and handle means connected to the plunger for selectively exerting a displacing force on the abutment means against the bias of the spring means toward the jaw causing said displacement of the abutment means into engagement with the edge of the part establishing said reaction point thereon, whereby continued exertion of the displacing force following said establishment of the reaction force displaces the jaw relative to the abutment means along the surface of the part to deform the retainer while in engagement with the jaw.

4. The tool as defined in claim 17 wherein the handle means includes a finger gripping bar fixed to the body and a thumb contact member against which the spring means reacts to exert said bias on the plunger and the abutment means.

* * * * *